United States Patent [19]

Scholes

[11] Patent Number: 5,033,628

[45] Date of Patent: Jul. 23, 1991

[54] NEWSPAPER STORAGE RACK

[76] Inventor: Dean C. Scholes, 12438 W. Banyan Dr., Sun City West, Ariz. 85375

[21] Appl. No.: 541,317

[22] Filed: Jun. 21, 1990

[51] Int. Cl.[5] ..... A47F 7/00

[52] U.S. Cl. ..... 211/50; 100/34

[58] Field of Search ..... 211/50, 49.1; 100/34, 100/1

[56] References Cited

U.S. PATENT DOCUMENTS

| | | | |
|---|---|---|---|
| 3,897,724 | 8/1975 | McDonald | 211/50 X |
| 3,952,876 | 4/1976 | Price | 100/34 X |
| 4,193,340 | 3/1980 | Finn | 211/50 X |
| 4,395,941 | 8/1983 | Metzger | 100/34 |
| 4,926,748 | 5/1990 | Smith et al. | 100/34 |

FOREIGN PATENT DOCUMENTS

| | | | |
|---|---|---|---|
| 611219 | 5/1979 | Switzerland | 100/34 |

*Primary Examiner*—Robert W. Gibson, Jr.

*Attorney, Agent, or Firm*—Leon Gilden

[57] ABSTRACT

A newspaper storage rack includes a central support junction mounting a respective first, second, third, and fourth base leg arranged at ninety degrees relative to one another, with each base leg including a junction to fixedly secure a respective first, second, third, and fourth tubular support relative to each horizontal base leg. Each upper terminal end of each tubular support includes a removable cap formed with a central opening therethrough. The central opening of aligned pairs of the caps relative to the vertical tubular supports position respective first and second string members therebetween to permit selective and subsequent securement of a stack of newspapers mounted within the storage rack.

4 Claims, 4 Drawing Sheets

PRIOR ART 28
26
28
25
10
22
21
28
24
28
27
18
17
14
11
13
20
23
12
15
19
16

NEWSPAPER STORAGE RACK

BACKGROUND OF THE INVENTION

1. Field of the Invention

The field of invention relates to storage rack apparatus, and more particularly pertains to a new and improved newspaper storage rack wherein the same secures a rectangular stack of newspapers and provides binding means for subsequent binding and securement of a newspaper stack.

2. Description of the Prior Art

In contemporary society, storage for subsequent disposal or recycling of newspapers is desirable to prevent undesirable strewing of such newspapers when not properly secured and positioned. Prior art storage rack apparatus includes U.S. Pat. No. 3,952,876 to Price providing a storage rack formed of wire or rod utilizing a base and upwardly extending legs to surroundingly secure a newspaper stack therewithin.

U.S. Pat. No. 4,193,340 to Finn sets forth a receptacle for securement of newspaper therewithin, wherein vertically arranged posts mounted on a support stand utilize string members secured to boss members of each post for subsequent tying of the newspaper bundles together.

U.S. Pat. No. 4,298,126 to Filipowicz sets forth a holder wherein a central support base includes a plurality of "U" shaped legs extending upwardly therefrom to secure a stack of papers therewithin.

U.S. Pat. No. 4,395,941 to Metzger sets forth a paper file and stack arrangement wherein a plurality of spools of string arranged rotatably within the base, wherein the base includes a series of upwardly extending legs for surrounding engagement of a bundle of stacked newspapers therewithin.

As such, it may be appreciated that there continues to be a need for a new and improved newspaper storage rack as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of newspaper storage rack apparatus now present in the prior art, the present invention provides a newspaper storage rack apparatus wherein the same provides a convenient surrounding perimeter of support legs for a newspaper stack and associated binding material therefore. As such, the general purpose of the present invention, which will be described subsequently in greater detail, is to provide a new and improved newspaper storage rack which has all the advantages of the prior art newspaper storage apparatus and none of the disadvantages.

To attain this, the present invention provides a newspaper storage rack including a central support junction mounting a respective first, second, third, and fourth base leg arranged at ninety degrees relative to one another, with each base leg including a junction to fixedly secure a respective first, second, third, and fourth tubular support relative to each horizontal base leg. Each upper terminal end of each tubular support includes a removable cap formed with a central opening therethrough. The central opening of aligned hairs of the caps relative to the vertical tubular supports position respective first and second string members therebetween to permit selective and subsequent securement of a stack of newspapers mounted within the storage rack.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description therefore that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposed of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provides a new and improved newspaper storage rack which has all the advantages of the prior art newspaper storage apparatus and none of the disadvantages.

It is another object of the present invention to provide a new and improved newspaper storage rack which may be easily and efficiently manufactured and marketed.

It is a further object of the present invention to provide a new and improved newspaper storage rack which is of a durable and reliable construction.

An even further object of the present invention is to provide a new and improved newspaper storage rack which is susceptible of a low cost of manufacture with regard to both materials and labor, and which accordingly is then susceptible of low prices of sale to the consuming public, thereby making such newspaper storage racks economically available to the buying public.

Still yet another object of the present invention is to provide a new and improved newspaper storage rack which provides in the apparatuses and methods of the prior art some of the advantages thereof, while simultaneously overcoming some of the disadvantages normally associated therewith.

Still another object of the present invention is to provide a new and improved newspaper storage rack wherein the same conveniently and readily positions a stack of newspapers for subsequent binding thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
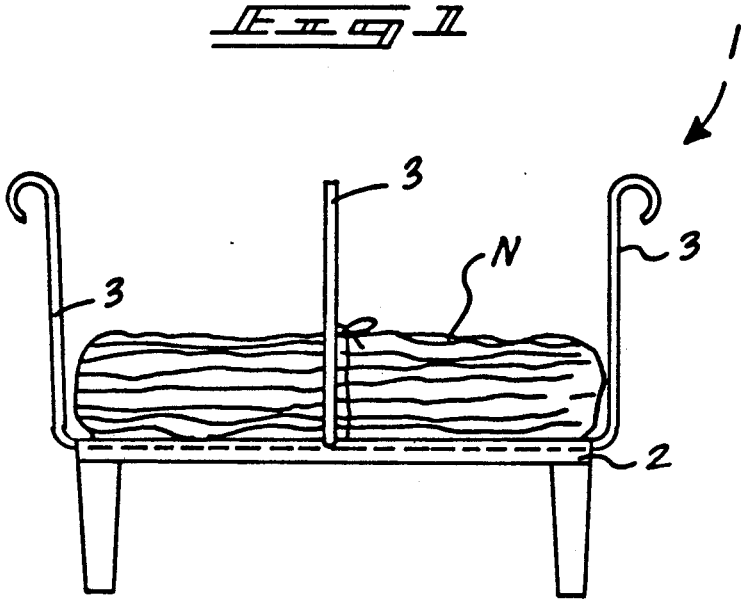
FIG. 1 is an orthographic side view, taken in elevation, of a prior art newspaper storage rack.

With reference now to the drawings, and in particular to FIGS. 1 to 8 thereof, a new and improved newspaper storage rack embodying the principles and concepts of the present invention and generally designated by the reference numeral 10 will be described.

Figure 2:
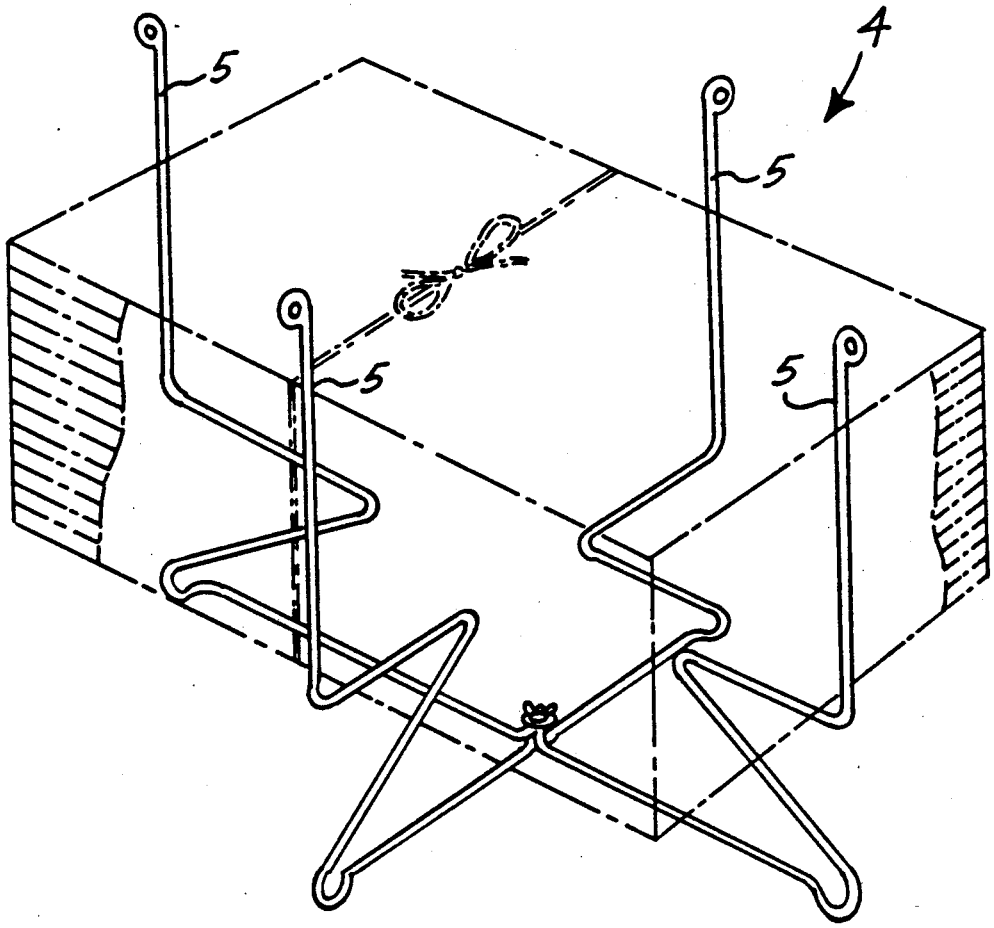
PRIOR ART FIG 2
FIG. 2 is an isometric illustration of a further prior art newspaper storage rack apparatus.
Figure 3:
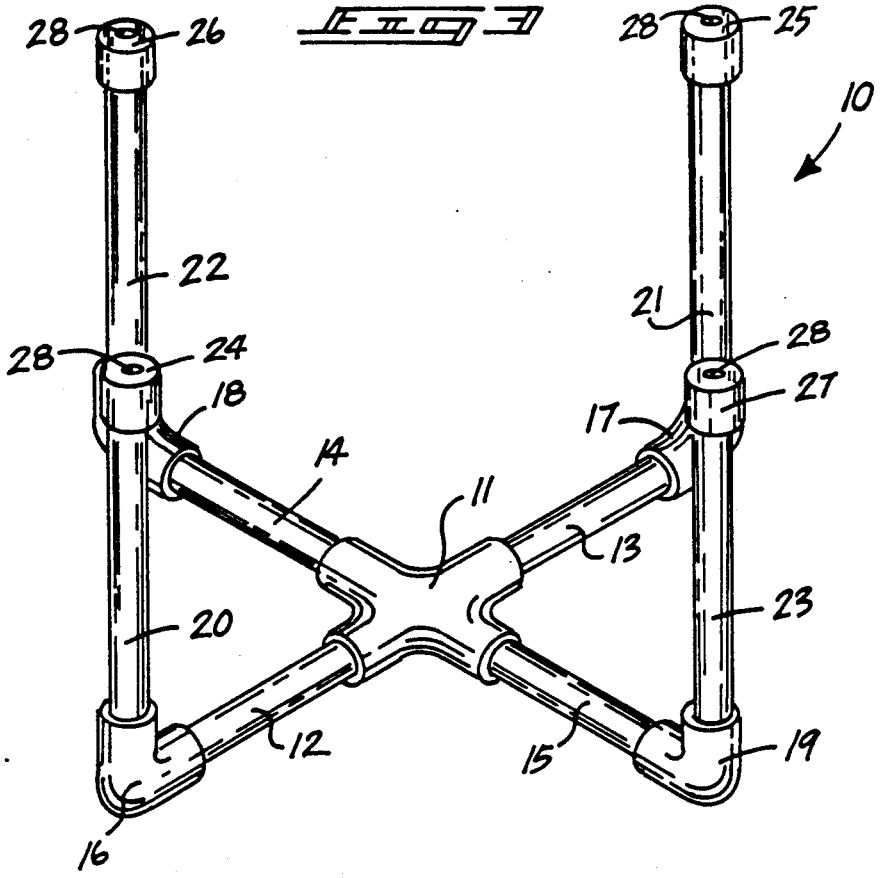
FIG. 3 is an isometric illustration of the instant invention.

FIG. 1 illustrates a prior art newspaper storage rack organization 1, wherein a plurality of vertical legs 3 are mounted to a support base 2 to secure a newspaper stack "N" therewithin. FIG. 2 illustrates a further prior art newspaper stack apparatus 4, wherein a series of vertical legs 5 are formed of wire rod and mounted and formed to a central horizontal crossed base support.

Figure 4:
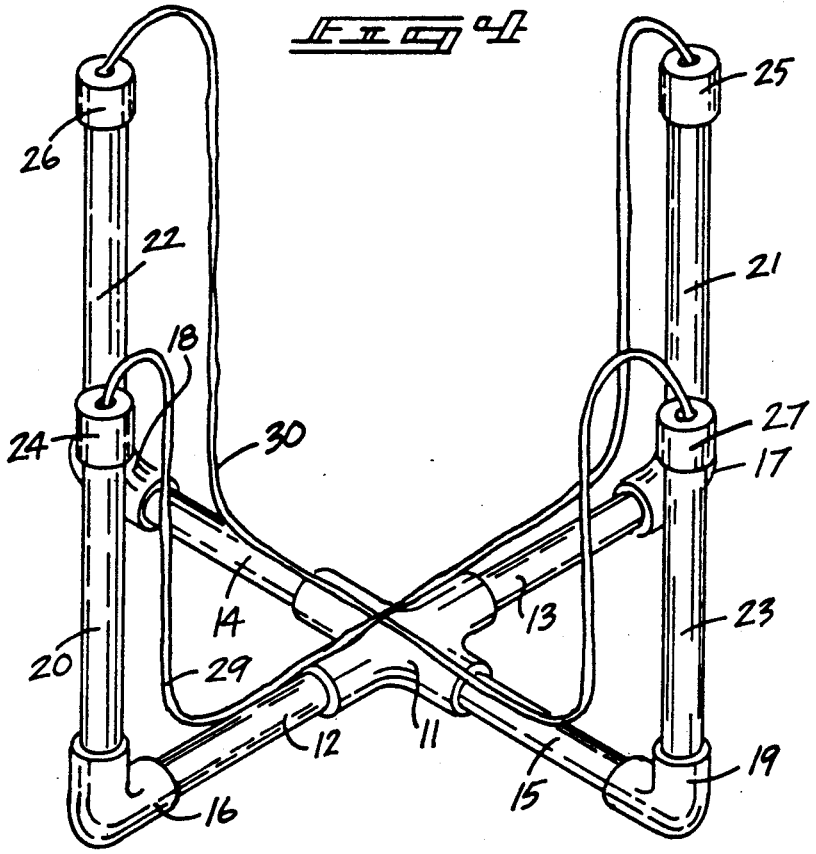
FIG. 4 is an isometric illustration of the instant invention utilizing binding members mounted therebetween.
Figure 5:
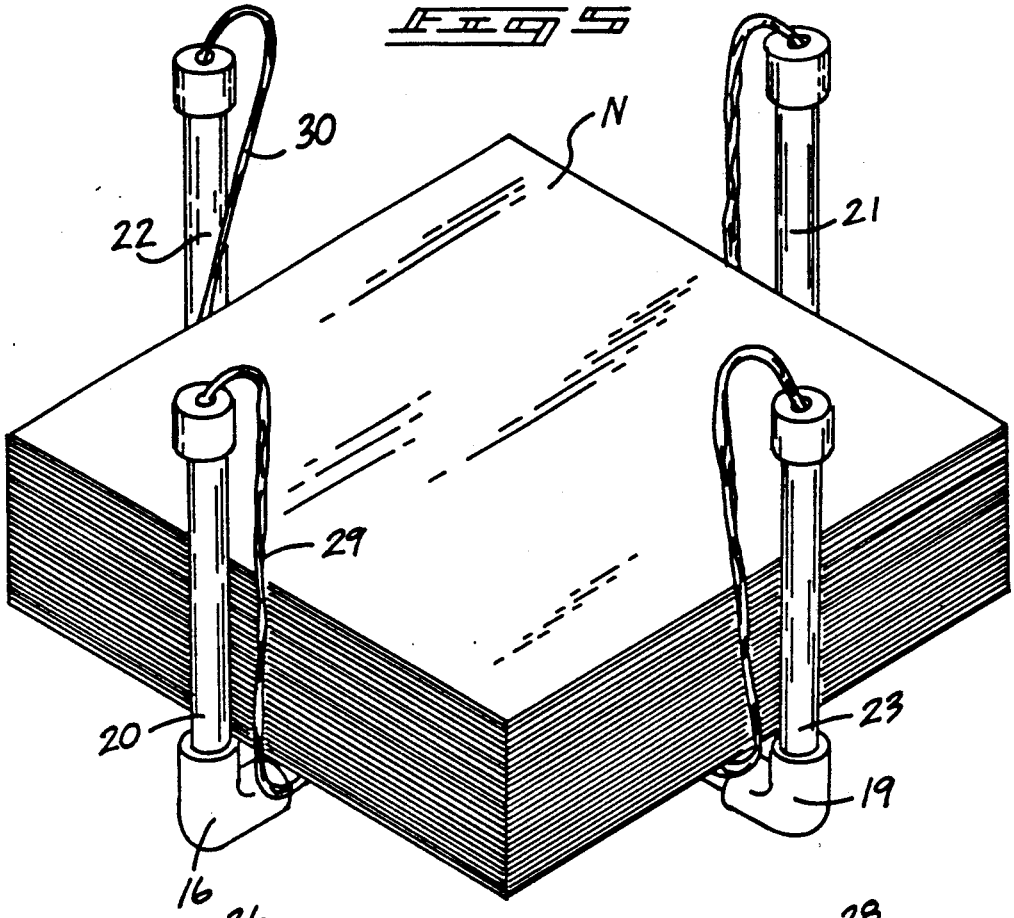
FIG. 5 is an isometric illustration of the instant invention illustrating the use of a stack of newspapers positioned within a storage rack.
Figure 6:
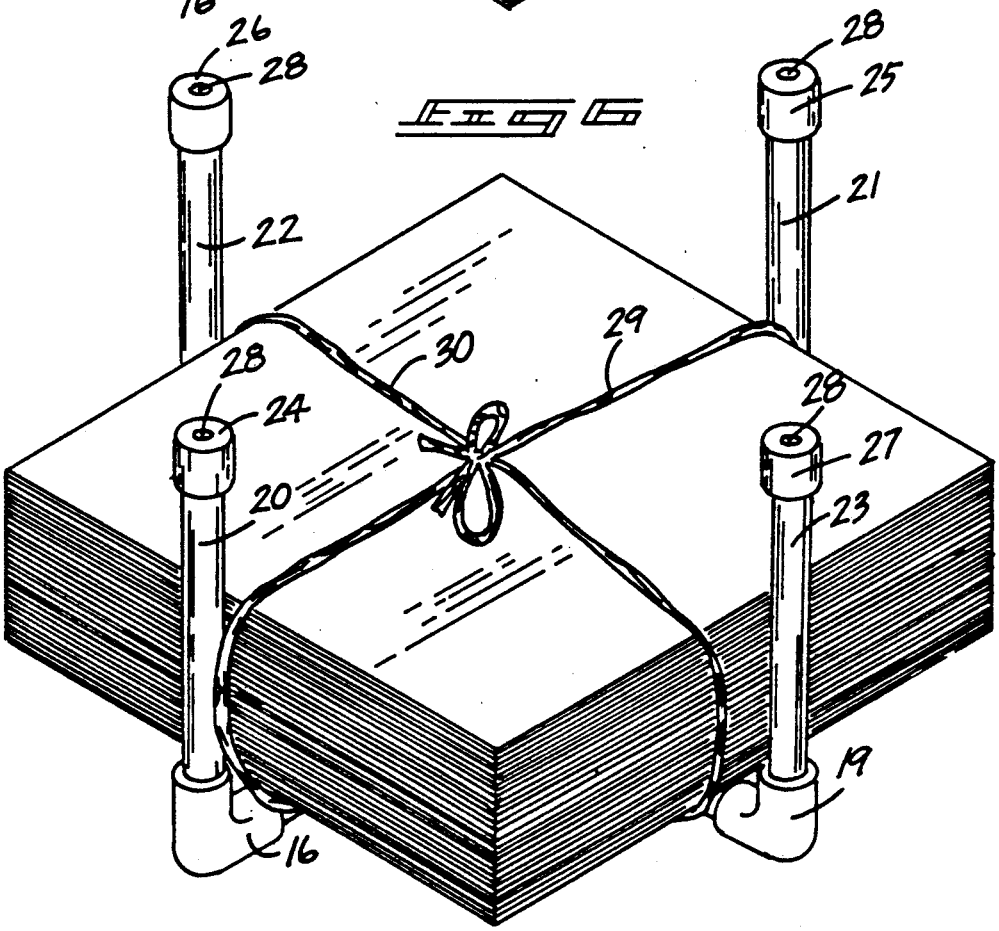
FIG. 6 is an isometric illustration of the instant invention with the newspapers bound within the storage rack of the instant invention.
Figure 7:
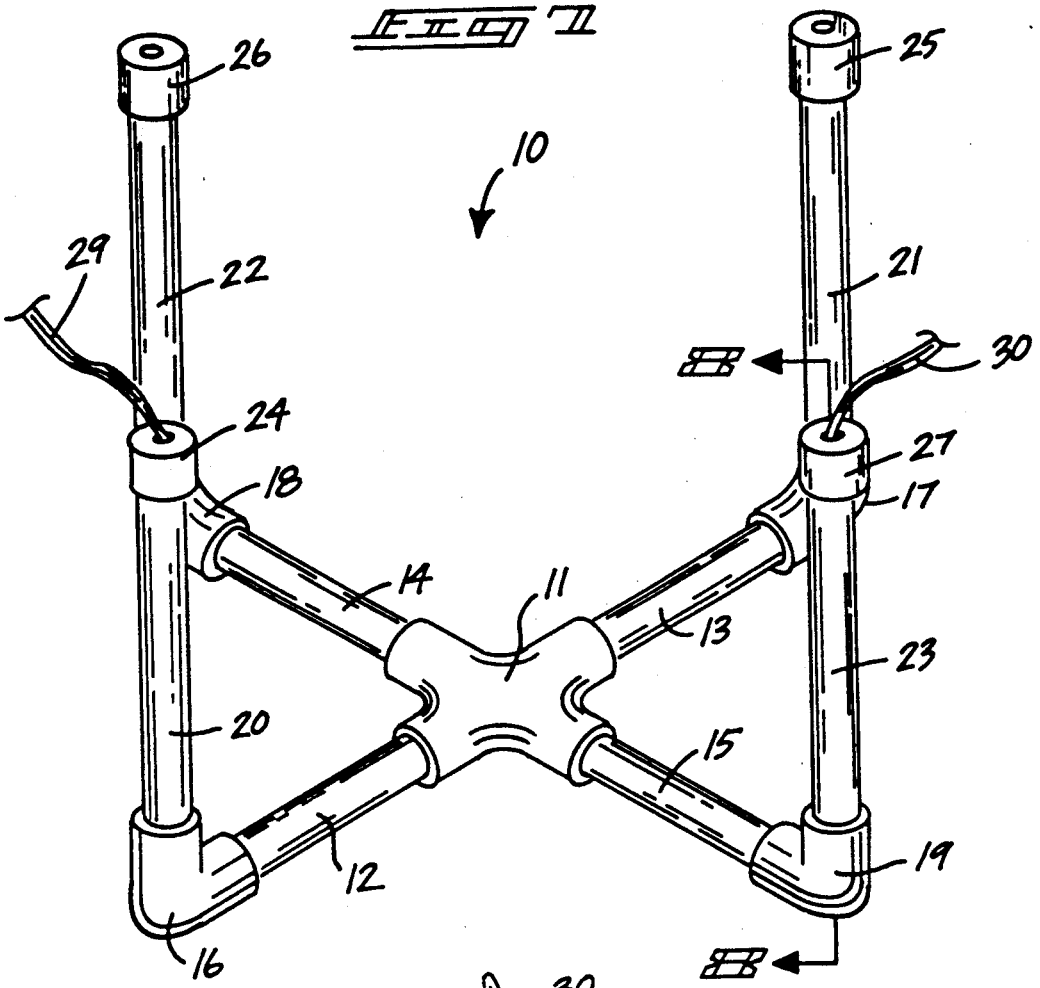
FIG. 7 is an isometric illustration of the instant invention utilizing opposed tubular supports of pairs of tubular supports for storage of a string column therewithin.
Figure 8:
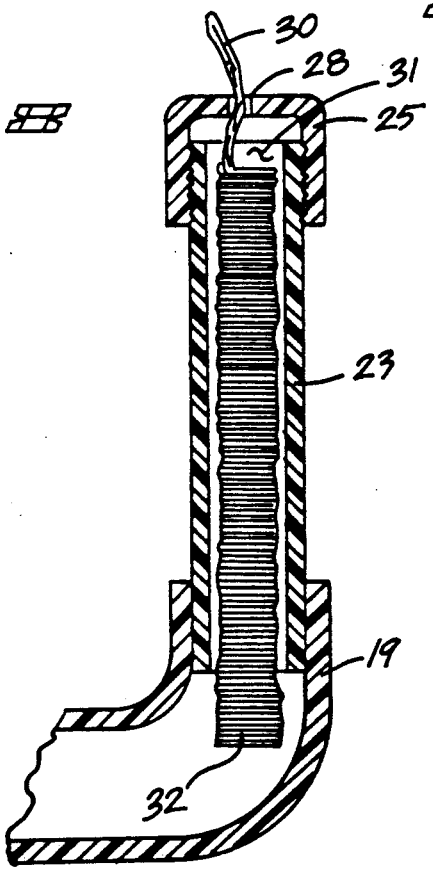
FIG. 8 is an orthographic view, taken along the lines 8—8 of FIG. 7, in the direction indicated by the arrows.

More specifically, the newspaper storage rack 10 of the instant invention essentially comprises a central support junction 11 providing structural and geometric integrity to the organization and formed with a series of four tubular legs arranged at ninety degrees relative to one another in horizontal plane. Each of the four legs include a respective first, second, third, and fourth horizontal base leg 12, 13, 14, and 15. Each of the respective base legs is mounted at an interior end of a respective tubular leg of the junction 11, with an exterior leg of each of the base legs including a respective elbow junction mounted thereto. The elbow junctions include a first, second, third, and fourth elbow junction 16, 17, 18, and 19 fixedly mounted to each exterior terminal end of each base leg. The base legs are of an equal predetermined length, with each elbow junction including a horizontal and vertical conduit, with each vertical conduit directed upwardly and orthogonally relative to each base leg. Secured within each elbow junction is a respective vertical tubular support defined by a first, second, third, and fourth tubular support 20, 21, 22, and 23 of a further predetermined length. Mounted to each upper terminal end of each tubular support is a threadedly removable cap defined by a first, second, third, and fourth removal cap 24, 25, 26, and 27 mounted to each respective tubular support. Each tubular cap includes a central bore 28 mounted orthogonally and coaxially therethrough in coaxial alignment not only with a cap, but with the tubular support associated with each cap. In use, a stack of newspapers "N" is positioned overlying the support junction 11 within the tubular supports, as illustrated in FIG. 5. Initially, a first and second string member 29 and 30 include opposed terminal ends mounted within respective first and second caps 24 and 25 as a first pair and through the central bore 28 of the third and fourth caps 26 and 27 as a second pair. When the stack of newspapers "N" are positioned thereon, the respective ends of the respective first and second string members are removed from the first and second pairs of caps for binding of the newspaper stack, in a manner as illustrated in FIG. 6. Alternatively, each tubular support is defined by a cylindrical magazine cavity 31, as illustrated in FIG. 8. The first and fourth tubular supports 20 and 23 receive a coiled cylindrical string column 32 therewithin, with an upper terminal end of each string directed and projecting outwardly from a cap through an associated central bore 28. In this manner, the first and second string members 29 and 30 may be projected across to an opposing tubular support, in a manner as illustrated in FIG. 4, to receive a stack of newspapers therewithin. Subsequent to stacking the newspapers, the desired length of string may be severed from the associated string column, with the string column remaining for subsequent use for a further stack of newspapers to be positioned thereon.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variation in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A newspaper storage rack apparatus comprising, in combination, a central support junction, the central support junction including a first, second, third, and fourth respective junction leg, and a respective first, second, third, and fourth horizontal base leg, wherein each horizontal base leg includes a respective inner terminal end mounted to a respective junction leg, and each horizontal base leg includes a respective outer end, and each respective outer end of each base leg includes a respective first, second, third, and fourth elbow junction mounted to each respective first, second, third, and fourth base leg outer terminal end, and each elbow junction includes a respective first, second, third, and fourth tubular support mounted to each respective first, second, third, and fourth elbow junction, and each tubular support is orthogonally arranged relative to each base leg, and each tubular support includes a removable cap mounted thereon.

2. An apparatus as set forth in claim 1 wherein each removable cap includes a central aperture coaxially aligned with a removable cap and with each respective tubular support.

3. An apparatus as set forth in claim 2 wherein the first and second tubular supports define a first tubular support pair, and the third and fourth tubular supports define a second tubular support pair, and a first string member is directed from the first tubular support to the second tubular support, with each terminal end of the first string member directed through a respective central bore of a respective first and second removal cap of the respective first and second tubular support, and a second string member including each terminal end of the second string member directed through a central bore of the third and fourth removable cap.

4. An apparatus as set forth in claim 3 wherein the first tubular support includes a cylindrical coiled string column positioned therewithin to define a first string member projecting through the first removable cap, and the third tubular column includes a further cylindrical coiled stringed column positioned within the third tubular support and projecting from the third tubular support through the third removable cap to define a second string member, with the first and second string members positioned to receive a newspaper stack thereupon for subsequent securement of the newspaper stack.

* * * * *